US006197158B1

(12) United States Patent
Steiner

(10) Patent No.: US 6,197,158 B1
(45) Date of Patent: Mar. 6, 2001

(54) DRYING SCREEN AND PROCESS FOR USING THE SAME

(75) Inventor: Karl Steiner, Herbrechtingen (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/103,584

(22) Filed: Jun. 24, 1998

(30) Foreign Application Priority Data

Jun. 25, 1997 (DE) ..... 19726933

(51) Int. Cl.[7] ..... D21F 2/00

(52) U.S. Cl. ..... 162/205; 162/306; 162/358.1; 162/358.2; 162/361

(58) Field of Search ..... 162/900, 358.1, 162/360.2, 360.3, 361, 359.1, 205, 306, 358.2

(56) References Cited

U.S. PATENT DOCUMENTS 3,617,442 * 11/1971 Hurschman ..... 162/900
4,271,222 * 6/1981 Hahn ..... 162/900
4,851,281 * 7/1989 Wood ..... 162/900
5,118,557 * 6/1992 Barnewall ..... 162/900
5,346,567 * 9/1994 Barnewall ..... 162/900

FOREIGN PATENT DOCUMENTS 578422 8/1976 (CH) .
1959085 7/1970 (DE) .
2456669 10/1975 (DE) .
3404544 8/1985 (DE) .
8816141 9/1989 (DE) .
29510307 12/1996 (DE) .
156062 10/1985 (EP) .

* cited by examiner

*Primary Examiner*—Peter Chin
(74) *Attorney, Agent, or Firm*—Greenblum & Bernstein P.L.C.

(57) ABSTRACT

Drying screen for a fibrous pulp web and process for using the same. The drying screen includes a support structure composed of one of a web or mesh, and an elastic coating having a shaped surface provided on a side of the support structure adapted to face the fibrous pulp web. The process of using the drying screen includes pressing the drying screen and the fibrous pulp web together, whereby the press device compresses the elastic layer of the drying screen, adhering the fibrous pulp web to the drying screen via suction after the pressing of the fibrous pulp web and drying screen, and guiding the fibrous pulp web on the drying screen.

3 Claims, 2 Drawing Sheets

DRYING SCREEN AND PROCESS FOR USING THE SAME

CROSS-REFERENCE TO RELATED APPLICATIONS

The present application claims priority under 35 U.S.C. §119 of German Patent Application No. 197 26 933.8, filed on Jun. 25, 1997, the disclosure of which is expressly incorporated by reference herein in its entirety.

BACKGROUND OF THE INVENTION

1. Field of the Invention

The present invention relates to a drying screen having a supporting structure composed of a web, mesh, or similar arrangement. The drying screen may be utilized in dryer sections for the manufacture of fibrous pulp webs.

2. Discussion of Background Information

Drying screens of the type generally described above are utilized to press a fibrous pulp web onto a corresponding dryer cylinder and to guide the fibrous pulp web between dryer cylinders, guide rolls, etc. However, when the fibrous pulp web is to be transferred from a smooth roll, e.g., a press roll or a dryer cylinder, undesirable longitudinal elongations of the fibrous pulp web may occur due to adhesion of the fibrous pulp web to the smooth roll surface.

SUMMARY OF THE INVENTION

The present invention improves the adhesion of the fibrous pulp web to the drying screen during a transfer of a fibrous pulp web from a roll.

The present invention provides an elastic coating layer having a shaped or profiled surface on at least portions of a side of the supporting structure facing the fibrous pulp web.

When the drying screen is stressed or compressed, i.e., when it is pressed against a supported fibrous pulp web, the surface area of the shaped surface of the supporting structure coating is reduced. Further, the fibrous pulp web can be supported by an especially smooth roll, e.g., in the press section, and the drying screen can be pressed onto the roll via screen tension or via an additional contact element acting on the drying screen.

Due to the elasticity of the coating, subsequent relaxation of the drying screen results in an enlargement or expansion of the shaped surface on the supporting structure. In this manner, an expansion of void spaces formed between the fibrous pulp web and the shaped surfaces of the coating occur. A low vacuum is formed in these void spaces that leads to an increased adhesion of the fibrous pulp web to the coating and, therefore, to the drying screen. As a result, an improved and secure transfer of the fibrous pulp web from the supporting element, e.g., press roll, is provided. As the fibrous pulp web proceeds beyond the supporting element, the vacuum created in the void spaces will become smaller as air is sucked into the voids through the fibrous pulp web and through a gap between the web and the coating until the vacuum dissipates or disappears. Once the vacuum in the void spaces has dissipated or disappeared the fibrous pulp web can be transferred to a subsequent unit, e.g., dryer section, without any problems.

The coating may be, e.g., an open-pore, elastic foam of polyurethane or rubber. Alternatively, the coating may include an elastic base material in which hard particles are embedded and that protrude from the surface in an unstressed state. These hard particles may effect the shape of the coating.

The coating with hard particles may be manufactured by applying an elastic base material together with the hard particles to the side of the supporting structure adapted to face the web and then removing an outer portion of the elastic base material using a chemical method, e.g., chemical solvent materials that do not attack the hard particles.

A circumference, location, and manufacture of the coating may be determined according to the type of drying screen or support structure, and to the degree of desired adhesion. Thus, the drying screen can be single-layered or multi-layered, symmetrical or asymmetrical, and/or formed as a spiral screen or fiber web or include a formed fabric.

The drying screen may be particularly suited for transferring the fibrous pulp web from smooth surfaces made of ceramic, mold casting, polyurethane, or rubber.

In particular, when the entire or large portions of the side of the support structure facing the fibrous pulp web is to receive an elastic coating, the surface may be prepared by spraying the coating onto the support frame.

Should the support structure be formed of a fiber web, the fibers are to be at least partially coated. It is also possible to coat only individual fibers and/or to form the fibers in the shape of a belt and coat only the side facing the fibrous pulp web.

In the event that the fibers are to be completely coated, it is advantageous to produce the coating for the fibers prior to manufacturing the drying screen, e.g., in a dip bath.

Moreover, with drying screens of this type, it may be possible to improve the transfer of the fibrous pulp web between two drying screens within a dryer section. This may be achieved by allowing the receiving drying screen to have a softer coating than the transferring drying screen. In this regard, the increased flexibility of the softer coating results in an increased vacuum in the void spaces, which leads to increased adhesion to the receiving drying screen.

The present invention is directed to a drying screen for a fibrous pulp web. The drying screen includes a support structure composed of one of a web or mesh, and an elastic coating having a shaped surface provided on a side of the support structure adapted to face the fibrous pulp web.

In accordance with another feature of the present invention, the coating includes an elastic base material having embedded hard particles that protrude from the shaped surface in an unstressed state.

In accordance with another feature of the present invention, the coating includes an open-pore, elastic foam. Further, the elastic foam includes one of polyurethane and rubber.

In accordance with still another feature of the present invention, the elastic coating is provided on an entire side of the support structure adapted to face the fibrous pulp web.

In accordance with a further feature of the present invention, the support structure includes a fiber web, and fibers of the fiber web are at least partially coated with the elastic coating. Further, individual fibers of the fiber web are coated with the elastic coating. Alternatively, the fiber web is a belt and only a side of the belt adapted to face the fibrous pulp web is coated with the elastic coating.

In accordance with still another feature of the present invention, the support structure includes a formed fabric positioned on the side adapted to face the fibrous pulp web, and the fibers of the formed fabric are coated with the elastic coating.

In accordance with another feature of the present invention, the drying screen is adapted for use in a dryer section of a machine to manufacture a fibrous pulp web such that the drying screen receives the fibrous pulp web from a preceding press section and guides the fibrous pulp web to the dryer section.

In accordance with a still further feature of the present invention, the drying screen is adapted for use to transfer the fibrous pulp web to a second drying screen within a dryer section, the second drying screen comprising a coating having a greater elasticity than the transferring drying screen.

In accordance with a further feature of the present invention, the drying screen is adapted to be guided through a press nip of a press section with the fibrous pulp web to drain the fibrous pulp web.

The present invention is directed to a process for applying an elastic coating to a support structure of a drying screen composed of one of a web or mesh. The process includes applying an elastic base material together with the hard particles to a side of the support structure adapted to face a fibrous pulp web, and chemically removing an outer portion of the elastic base material. The chemical removal does not affect the hard particles.

The present invention is also directed to a drying screen that includes a support structure composed of a plurality of fibers, and an elastic layer, located on a side of the support structure adapted to receive a fibrous pulp web, adapted to create a vacuum to adhere the fibrous pulp web to the elastic layer.

In accordance with another feature of the present invention, the elastic layer is applied to an entirety of the side of the support structure. Further, the elastic layer is applied to a portion of the side of the support structure adapted to receive edges of the fibrous pulp web.

In accordance with still another feature of the present invention, the elastic layer has a profile in an unstressed condition that is adapted to be compressed under stress.

In accordance with still another feature of the present invention, the elastic layer includes voids adapted to create a vacuum on the surface of the support structure adapted to face the fibrous pulp web to suction the fibrous pulp web to the elastic layer.

The present invention is also directed to a process for transferring a fibrous pulp web onto a drying screen. The drying screen includes a support structure composed of one of a web or mesh and an elastic coating having a shaped surface provided on a side of the support structure adapted to face the fibrous pulp web. The process includes pressing the drying screen and the fibrous pulp web together, whereby the press device compresses the elastic layer of the drying screen, adhering the fibrous pulp web to the drying screen via suction after the pressing of the fibrous pulp web and drying screen, and guiding the fibrous pulp web on the drying screen.

In accordance with another feature of the present invention, the process further includes pressing the fibrous pulp web between the drying screen and a second drying screen located within the dryer section, and transferring the fibrous pulp web to the second drying screen. The second drying screen includes a coating having a greater elasticity than the drying screen.

In accordance with yet another feature of the present invention, the process further including guiding the drying screen and the fibrous pulp web through a press nip of the press device. In this manner, the fibrous pulp web is drained.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

The invention will be explained in more detail in the following with the aid of several embodiments. The attached drawings show.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
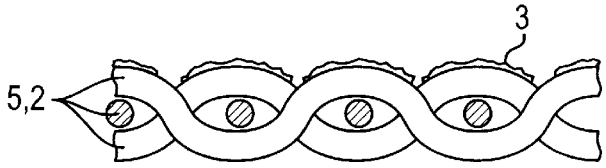
FIG. 1 illustrates a fiber web having a coating applied via a spray method.
Figure 2:
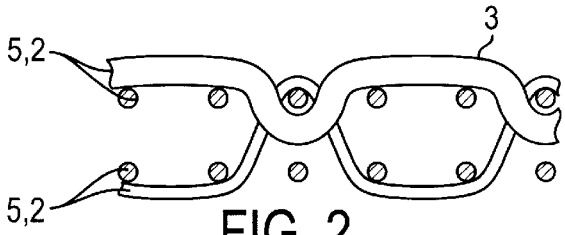
FIG. 2 illustrates a fiber web with coated fibers.
Figure 3:
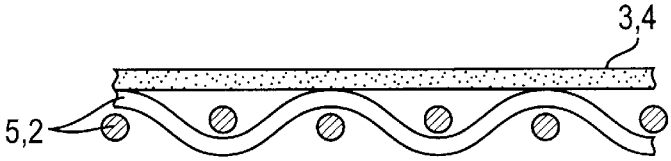
FIG. 3 illustrates a support structure of a formed fabric.

A support structure 2 of a drying screen 6, as illustrated in FIGS. 1–3, may be formed of a web of fibers 5. At least portions of support structure 2 that are positioned to face a fibrous pulp web 1 include an elastic coating 3 having a shaped or profiled surface. Coating 3 may include an open-pore foam, preferably of polyurethane or rubber, or may be formed of an elastic base material with embedded particles that protrude from the shaped surface when the coating, and the drying screen 6, are in an unstressed state.

As depicted in FIG. 1, drying screen 6 may include a coating 3 that is applied on the entire side of the screen facing fibrous pulp web 1, preferably via a spray method. However, it is also possible to coat only certain sections of the side of drying screen 6 facing fibrous pulp web 1, e.g., the sections adapted to receive the edges of fibrous pulp web 1.

As illustrated in FIG. 2, only certain fibers 5 of support structure 2 may be coated. However, these certain fibers 5 are entirely covered with coating 3, i.e., prior to the manufacture of drying screen 6. Alternatively, FIG. 3 illustrates support structure 2 having a formed fabric 4 positioned on the side facing fibrous pulp web 1. A side of fabric 4 facing fibrous pulp web 1 may be coated, preferably via spray method.

In the exemplary embodiments depicted in FIGS. 1–3, all have in common that the shape of the coating 3 shrinks or is compressed during a transfer or, more specifically, during relatively high pressure. When the stress or pressure eases afterwards, an enlargement or expansion of the void spaces between coating 3 and fibrous pulp web 1 leads to a formation of a low vacuum, and, thus, to an improved adhesion of fibrous pulp web 1 to drying screen 6. After a short period of time, the vacuum in the voids disappears or dissipates and the increased adhesion between drying screen 6 and fibrous pulp web 1 returns to normal.

Figure 5:
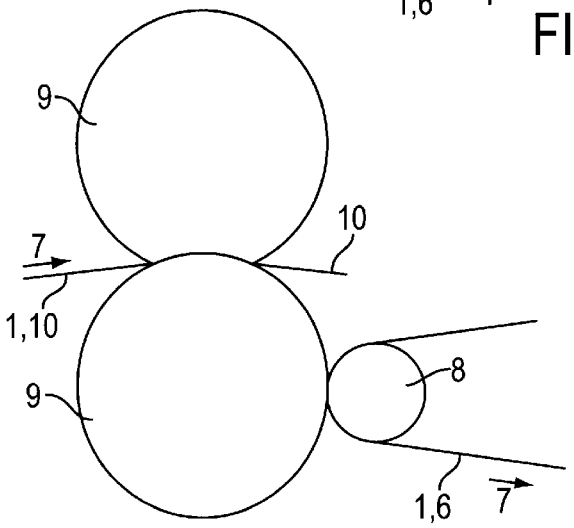
FIG. 5 illustrates a transfer of a fibrous pulp web from a press roll to a drying screen.

FIG. 5 illustrates a press roll having a press nip or opening through which, in addition to fibrous pulp web 1, a drainage or dewatering felt 10 is guided. After passing through the press nip, fibrous pulp web 1 is guided along smooth press roll 9 until it is transferred to drying screen 6. In order to increase the contact pressure of drying screen 6 onto press roll 9, drying screen 6, and the shaped surface of coating 3, may be pressed against press roll 9 via a guide or transfer roll 8. After passing through the press nip formed between press roll 9 and guide roll 8, the shaped surface of coating 3 may expand back to its normal shape.

Thus, the creation of a vacuum within the voids and the adhesion of fibrous pulp web 1 to drying screen 6 results in fibrous pulp web 1 following (or being guided by) drying screen 6 in a web run direction 7 without or with only minimal elongations.

In a further embodiment of the present invention, it is also possible to improve the transfer of fibrous pulp web 1 between two drying screens 6 and 6' within a dryer section. To provide such a transfer, a receiving screen 6' should have a greater degree of adhesion with respect to fibrous pulp web 1 than a transferring drying screen 6.

This greater degree of adhesion may be achieved, e.g., if transferring screen 6 is not provided with a coating 3 or if coating 3 of transferring screen 6 is harder than coating 3 of receiving screen 6'. In either case, the vacuum created in voids of transferring drying screen 6 will be less than the vacuum created in the voids of receiving drying screen 6' because the softer coating will undergo greater shape changes due to the compression and expansion of coating 3 due to the pressure between the transferring and receiving screens 6 and 6'.

Figure 4:
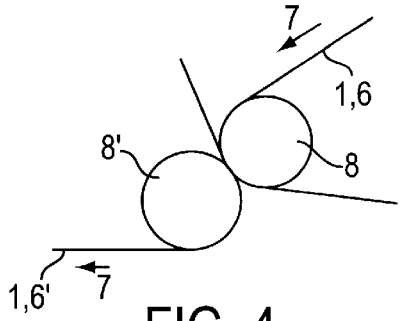
FIG. 4 illustrates a transfer of a fibrous pulp web between two drying screens.

FIG. 4 illustrates the above-noted transfer between two drying screens 6 and 6', which are respectively guided over screen guide rolls 8 and 8'. Drying screens 6 and 6' may be pressed together either by pressing screen guide rolls 8 and 8' together or via screen tension such that receiving screen 6' may be pressed against screen guide roll 8 of the transferring screen 6.

Figure 6:
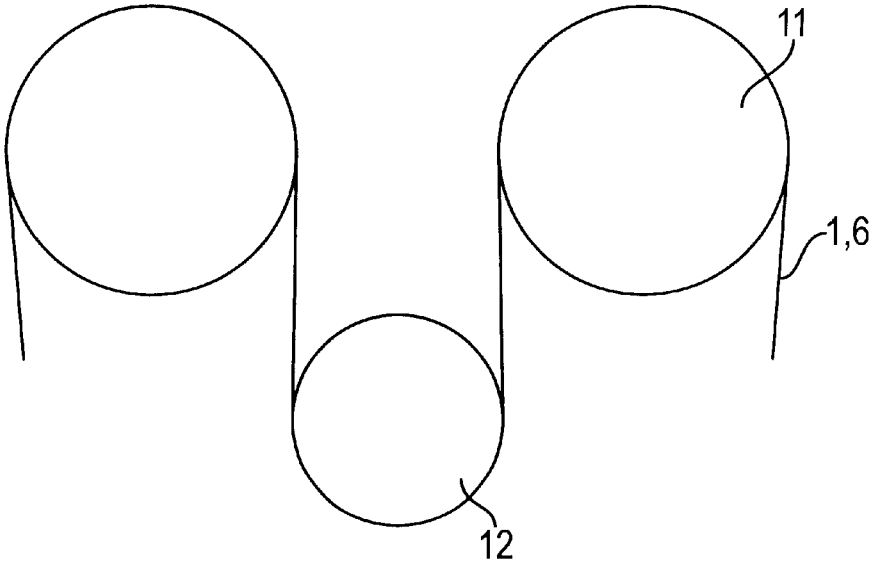
FIG. 6 illustrates a guidance system of the fibrous pulp web on a drying screen in a dryer group.

FIG. 6 illustrates a portion of a dryer section in which drying screen 6, together with fibrous pulp web 1, is guided in an alternating or meandering fashion over dryer cylinders 11 and guide roll 12. Drying screen 6, which is guided around the exterior, presses fibrous pulp web 1 against dryer cylinder 11 via screen tension. Each time after leaving drying cylinder 11, coating 3 relaxes to provide better adhesion to fibrous pulp web 1, which results in better material web guidance in the subsequent process.

Figure 7:
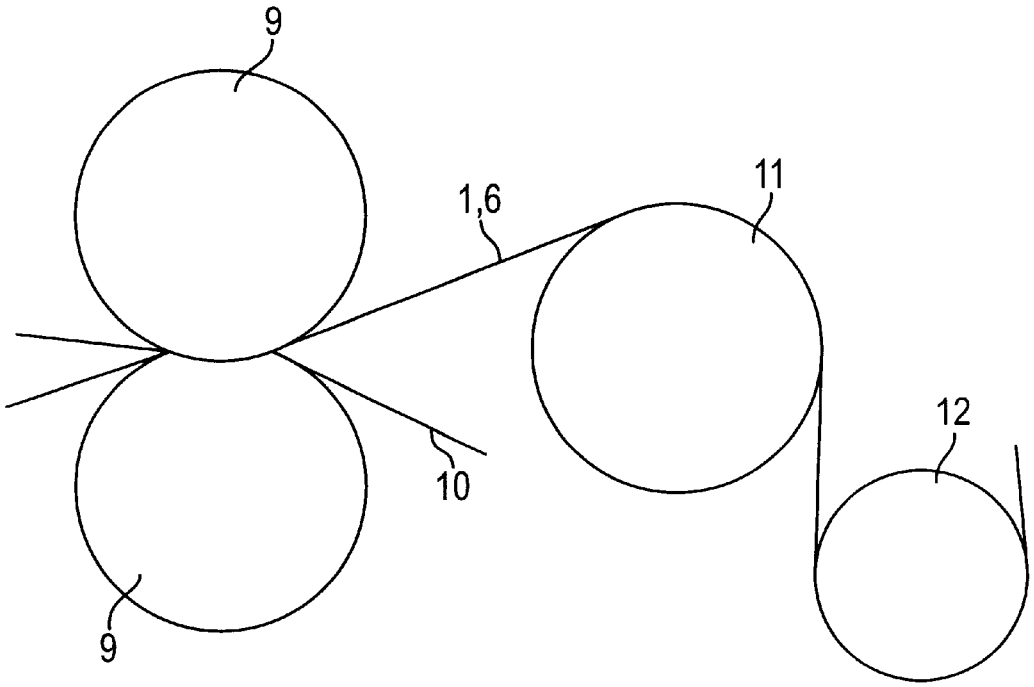
FIG. 7 illustrates the guidance system of the fibrous pulp web on a drying screen through a press opening.

However, it also possible, as illustrated in FIG. 7, to guide drying screen 6 together with fibrous pulp web 1 through a press nip created between two press rolls 9 of a press section preceding a dryer section. After leaving the press nip, drying screen 6 guides fibrous pulp web 1 to a subsequent unit in which, e.g., fibrous pulp web 1 runs together with drying screen 6 over dryer cylinder 11 and guide rolls 12.

Further, should drying screen 6 be produced to be able to absorb a sufficient amount of water, drainage felts 10 may be avoided. However, in FIG. 7, aside from drying screen 6 being positioned on top of fibrous pulp web 1, drainage felt 10 spools around the bottom of press roll 9. Because of the adhesion of fibrous pulp web 1 to drying screen 6, precise guidance of fibrous pulp web 1 may be ensured after passing through the press nip.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for transferring a fibrous pulp web onto a drying screen, the drying screen including a support structure composed of one of a web or mesh and an elastic coating having a shaped surface provided on a side of the support structure adapted to face the fibrous pulp web, the process comprising:

pressing the drying screen against the fibrous pulp web, whereby the elastic layer compresses against the fibrous pulp web;

adhering the fibrous pulp web to the drying screen via temporary suction by the elastic layer after the pressing of the drying screen against the fibrous pulp web;

guiding the fibrous pulp web on the shaped surface of the drying screen.

2. The process in accordance with claim 1, wherein, the temporary vacuum ends after complete expansion of the elastic layer, and, after the temporary vacuum ends, the process further comprises:

pressing the fibrous pulp web between the drying screen and a second drying screen located within the dryer section; and transferring the fibrous pulp web to the second drying screen via a temporary vacuum created by the second drying screen, wherein the second drying screen comprises an elastic coating having a greater elasticity than the drying screen.

3. The process in accordance with claim 1, further comprising:

guiding the drying screen and the fibrous pulp web through a press nip of the press device, whereby the fibrous pulp web is drained.

* * * * *